US008706002B2

(12) United States Patent
Kim et al.

(10) Patent No.: US 8,706,002 B2
(45) **Date of Patent: *Apr. 22, 2014**

(54) IMAGE FORMING APPARATUS WITH CARTRIDGE SUPPORT

(71) Applicant: Samsung Electronics Co., Ltd, Suwon-si (KR)

(72) Inventors: Sung-dae Kim, Suwon-si (KR); Jung-Jae Lee, Yongin-si (KR); Hak-kyum Kim, Seoul (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 13/707,628

(22) Filed: Dec. 7, 2012

(65) Prior Publication Data

US 2014/0086623 A1 Mar. 27, 2014

Related U.S. Application Data

(63) Continuation of application No. 12/142,183, filed on Jun. 19, 2008, now Pat. No. 8,340,548.

(30) Foreign Application Priority Data

Jul. 3, 2007 (KR) ..... 10-2007-0066269

(51) Int. Cl.
*G03G 15/00* (2006.01)
*G03G 21/16* (2006.01)

(52) U.S. Cl.
CPC ..... *G03G 21/16* (2013.01)
USPC ..... 399/107; 399/111

(58) Field of Classification Search
CPC ..... G03G 21/16; G03G 21/1853; G03G 21/1857; G03G 2221/1678; G03G 2221/1654; G03G 2221/169; G03G 2221/183; G03G 2221/1884; G03G 2221/1657; G03G 15/00
USPC ..... 399/107, 111, 167, 110, 125
See application file for complete search history.

(56) References Cited

U.S. PATENT DOCUMENTS 5,047,803 A 9/1991 Kanoto
5,708,922 A 1/1998 Azuma et al.

(Continued)

FOREIGN PATENT DOCUMENTS

JP 8-297453 11/1996
JP 2002-149036 5/2002

OTHER PUBLICATIONS

Korean Office Action issued Nov. 3, 2011 in KR Application No. 10-2007-0066269.

(Continued)

*Primary Examiner* — Billy Lactaoen
(74) *Attorney, Agent, or Firm* — Stanzione & Kim, LLP

(57) ABSTRACT

An image forming apparatus, includes: a main body frame; a process cartridge which comprises a driven gear unit which is driven to form a visible image on an image carrying body; and a bracket device which comprises a bracket main body which is coupled to the main body frame, a driving gear unit which is supported to the bracket main body, and which is to be engaged with the driven gear unit, and a guide which guides the process cartridge into a mounting position in the main body frame.

15 Claims, 4 Drawing Sheets

(56) References Cited

U.S. PATENT DOCUMENTS

| | | | | |
|---|---|---|---|---|
| 8,340,548 | B2 * | 12/2012 | Kim et al. | 399/107 |
| 2004/0264996 | A1 | 12/2004 | Aiba | |
| 2006/0045566 | A1 | 3/2006 | Kanno et al. | |
| 2008/0264277 | A1 | 10/2008 | Koizumi | |

OTHER PUBLICATIONS

English Language abstract of JP 8-297453, published Nov. 12, 1996.

English Language abstract of JP 2002-149036, published May 22, 2002.

United States Notice of Allowance issued Aug. 24, 2012 in U.S. Appl. No. 12/142,183.

United States Non-Final Office Action issued Feb. 29, 2012 in U.S. Appl. No. 12/142,183.

United States Final Office Action issued Nov. 25, 2011 in U.S. Appl. No. 12/142,183.

United States Non-Final Office Action issued Jun. 22, 2011 in U.S. Appl. No. 12/142,183.

* cited by examiner

IMAGE FORMING APPARATUS WITH CARTRIDGE SUPPORT

CROSS-REFERENCE TO RELATED APPLICATIONS

This application is a Continuation Application of prior application Ser. No. 12/142,183, filed on Jun. 19, 2008 in the United States Patent and Trademark Office, which claims priority from Korean Patent Application No. 10-2007-0066269, filed on Jul. 3, 2007 in the Korean Intellectual Property Office, the disclosure of which is incorporated herein by reference in its entirety.

BACKGROUND OF THE INVENTION

1. Field of the Invention

The present invention relates to the mounting of a removable cartridge in an image forming apparatus, and more particularly to, a mounting support bracket for supporting a cartridge within a main body frame of an image forming apparatus, and an image forming apparatus employing the same.

2. Description of the Related Art

An image forming apparatus may typically include one or more cartridges that are removable from the main body frame of the image forming apparatus to be replaced and/or replenished. For example, a cartridge may hold a supply of toner for developing electrostatic latent image formed on a surface of an image carrying body (or a photosensitive body), and may include, among other things, a developing roller, which supplies the toner to the image carrying body to develop the electrostatic latent image, and may or may not also include within the cartridge the photosensitive body itself. These cartridges are typically removable from the main housing of the image forming apparatus, for example, to be replaced and/or replenished when the supply of toner is spent, or to replace worn out components, for example, the developing roller and/or the photosensitive body.

One or more of the movable portions or components of the cartridge, for example, the image carrying body and/or the developing roller, are in operation required to move in certain controllable manner. For example, the developing roller and the image carrying body are typically made to rotate during operation. The rotational force is typically supplied from a source of motional force provided in the main housing of the image forming apparatus. The motional force from the source is transferred to the components within the cartridge through one or more gears provided in the cartridge housing. These gears may be engaged to, and thus are "driven" by, another gear or a set of gears provided in the main housing when the cartridge are installed in the image forming apparatus, and may become disengaged from the driving gear of the main housing when the cartridge is removed from the main housing of the image forming apparatus.

In a conventional image forming apparatus, a guide may be formed on the main body frame, along which a cartridge is guided into position during the mounting of the cartridge, and which may also support the cartridge in the mounted position within the main body frame. A separate bracket on which a driving gear or gears may be disposed is typically coupled to the main body frame for engagement with the driven gear(s) of the cartridge so that the driving force can be transmitted to, e.g., the image carrying body and/or the developing roller.

However, in a conventional image forming apparatus, the guide and the driving gears are provided on separate bodies, as described above, namely, e.g., the guide being formed on the main body frame while the driving gears being provided in a separate bracket. In this configuration, unfortunately, there may be a misalignment between the support bracket and the main body frame. For example, the mounting position of the bracket may be off, or over time the relative positions of the bracket and the main frame may shift. The misalignment, whatever its cause may be, may result in an improper engagement between the driving gear(s) and the respective driven gear(s) when the cartridge is guided by the guide into the mounted position.

In this case, since the driving force from the driving gears is not effectively transmitted to the driven gears, the operation of the cartridge, more particularly, the rotation of the image carrying body and/or the developing roller may be improperly performed, which in turn may result in inferior image quality.

SUMMARY OF THE INVENTION

Accordingly, it is an aspect of the present invention to provide an image forming apparatus minimizing an engagement between gear units transmitting a driving force to a process cartridge being in an out of tolerance condition when the process cartridge is mounted to a main body frame.

Additional aspects of the present invention will be set forth in part in the description which follows and, in part, will be obvious from the description, or may be learned by practice of the present invention.

The foregoing and/or other aspects of the present invention can be achieved by providing an image forming apparatus, including: a main body frame; a bracket comprising a bracket main body coupled to the main body frame, the bracket main body having disposed thereon at least one driving gear unit and at least one support guide, the at least one driving gear unit being configured to engage at least one driven gear unit of a removable process cartridge when the removable process cartridge is mounted in a mounted position within the image forming apparatus, the at least one support guide being configured to guide the removable process cartridge into the mounted position during mounting of the removable process cartridge in the image forming apparatus.

According to an aspect of the present invention, the image forming apparatus further includes the removable process cartridge, the removable process cartridge comprising at least one movable portion configured to move according to a motional force received from the at least one driven gear unit and at least one mounting support portion configured to be in a sliding contact with the at least one support guide during the mounting of the removable process cartridge, the at least one mounting support portion being supported by the at least one support guide when the removable process cartridge is in the mounted position.

According to another aspect of the present invention, the at least one mounting support portion comprises one or more protrusions extending outward from an outer surface of the removable process cartridge, and wherein the at least one support guide comprises one or more grooves extending along the bracket main body, each of the one or more grooves being configured to receive at least a part of a corresponding one of the one or more protrusions.

According to yet another aspect of the present invention, at least one of the one or more grooves having an entrance portion into which the corresponding one of the one or more protrusions enters during the mounting of the removable process cartridge, the entrance portion having a larger opening than remaining portions of the one or more grooves.

According to even yet another aspect of the present invention, the at least one support guide is integrally formed on the bracket main body.

According to another aspect of the present invention, the at least one driving gear unit comprises a first driving gear unit and a second driving gear unit, the first driving gear unit is configured to engage, when the removable process cartridge is mounted in the image forming apparatus, with a first driven gear unit, the first driven gear unit being coupled to, and being configured to convey a first rotational force received from the first driving gear unit to, an image carrying body disposed within the removable processing cartridge, the image carrying body being configured to form an electrostatic latent image on a surface thereof, and the second driving gear unit is configured to engage a second driven gear unit, the second driven gear unit being coupled to, and being configured to convey a second rotational force received from the second driving gear unit to, one or more developing rollers disposed within the removable process cartridge, the one or more developing roller each being configured to supplies an amount of developer to the image carrying body to develop the electrostatic latent image into a visible image.

According to another aspect of the present invention, the main body frame comprises a first through hole and second through hole, the first through hole providing a first opening through which the first driving gear unit of the bracket is allowed enter into an interior portion of the main body frame during mounting of the bracket onto the main body frame, the second through hole providing a second opening through which the second driving gear unit is allowed enter into the interior portion of the main body frame during mounting of the bracket onto the main body frame.

According to another aspect of the present invention, the second driving gear unit comprises a first plurality of gears, each configured to engage with a respective corresponding one of a second plurality of gears of the second driven gear unit, each of the second plurality of gears being configured to rotate a respective corresponding one of the one or more developing roller each being configured to supply a respective different color developer to the image carrying body.

The foregoing and/or other aspects of the present invention can be achieved by providing a bracket device which is employed for an image forming apparatus which includes a main body frame, and a process cartridge which includes a driven gear unit which is driven to form a visible image on a printing medium, the bracket device including: a bracket main body which is coupled to the main body frame; a driving gear unit which is supported to the bracket main body to be engaged with the driven gear unit; and a guide which slidably guides the process cartridge to be mounted to the main body frame.

BRIEF DESCRIPTION OF THE DRAWINGS

These and/or other aspects of the present invention will become apparent and more readily appreciated from the following description of the embodiments, taken in conjunction with the accompanying drawings, in which.

DETAILED DESCRIPTION OF THE PREFERRED EMBODIMENTS

Figure 1:
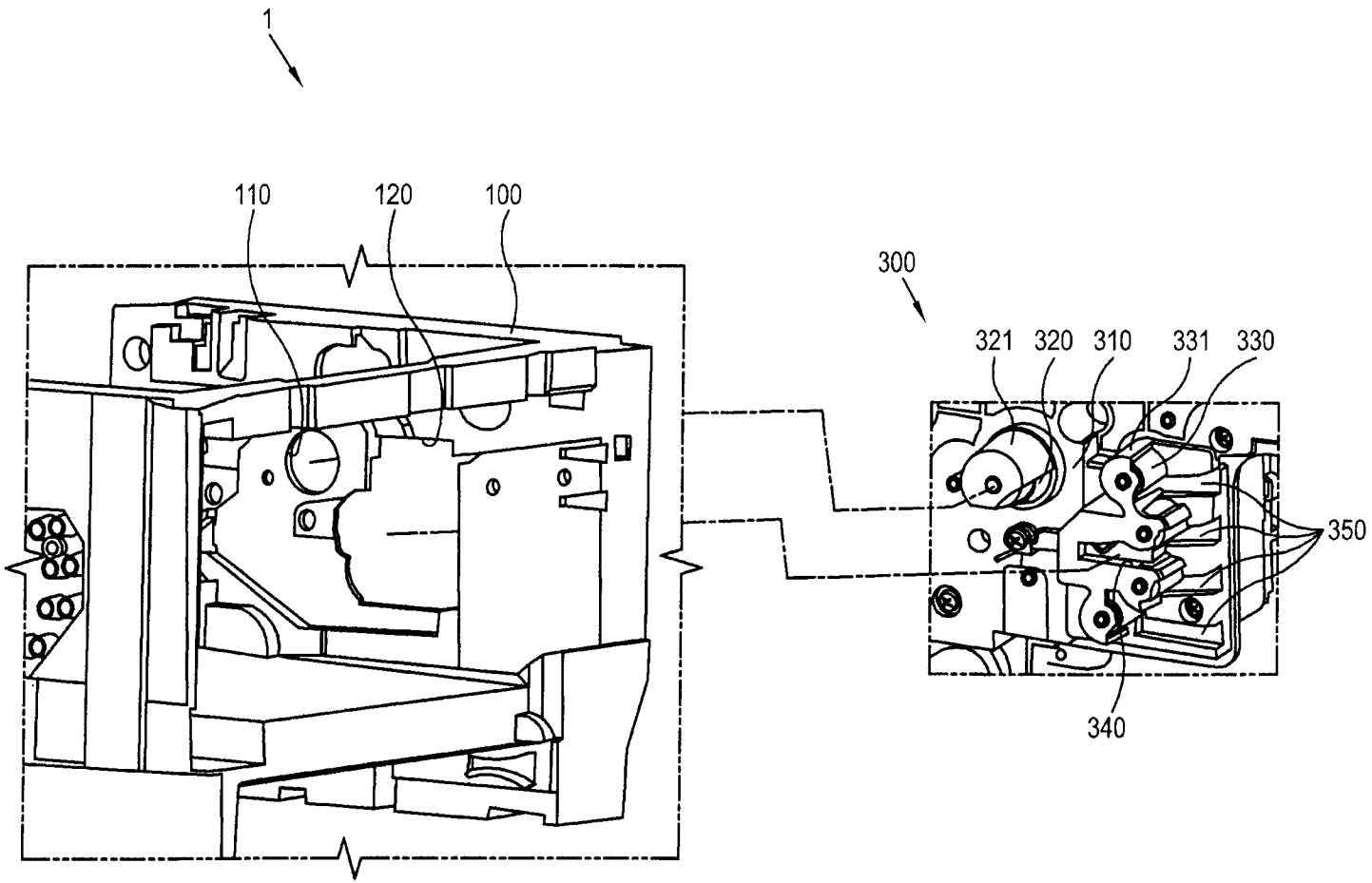
FIG. 1 is an exploded perspective view illustrating relevant portions of a main body frame and a cartridge support bracket in an image forming apparatus according to an embodiment of the present invention.
Figure 2:
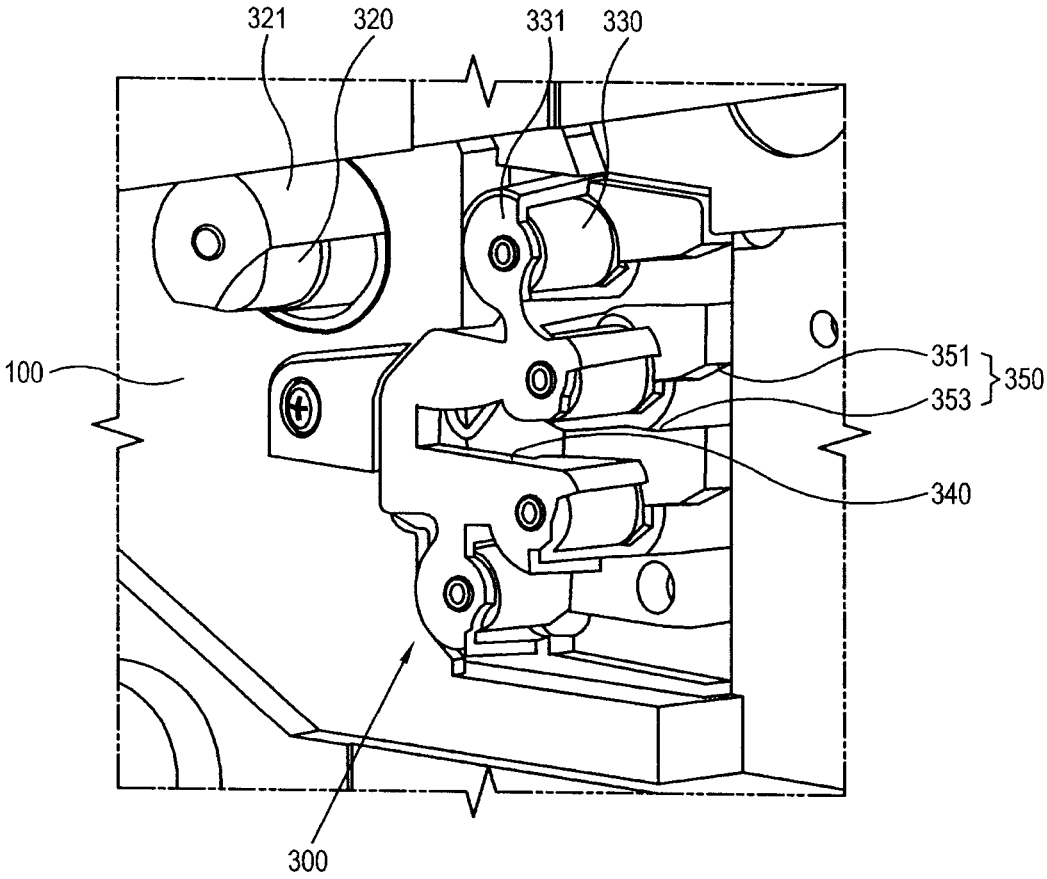
FIG. 2 is a perspective view illustrating the relevant portions of the main body frame and the cartridge support bracket mounted thereon in the image forming apparatus shown in FIG. 1.

Reference will now be made in detail to the embodiments of the present invention, examples of which are illustrated in the accompanying drawings, wherein like reference numerals refer to like elements throughout. The embodiments are described below, referring to the figures.

As shown in FIGS. 1 to 4, an image forming apparatus 1 according to an embodiment of the present invention may include a main body frame 100, a removable cartridge 200 for forming an image, and a support bracket 300 fixable to the main body frame 100 for detachably supporting the cartridge 200 in the main body frame 100. The main body frame 100 may support and/or house other various components of the image forming apparatus 1.

The main body frame 100 may support the opposite ends of one or more movable portions of the cartridge 200, for example, support can be provided to the opposing ends along the length of an image carrying body 211 and/or a developing roller 223. Accordingly, the image carrying body 211 and/or the developing roller 223 may rotate about an axis along the respective length thereof to apply the toner or the developer to the electrostatic latent image formed on the image carrying body 211. According to this embodiment, the cartridge support structure may be provided on at least one side surface of the main body frame 100 to provide the support for one end of the cartridge 200, which is mounted to and removed from the main body frame 100 in cooperation with the support structure provided on the side surface of the main body frame 100. Hereinafter, such surface of the main body frame 100 will be referred to as the surface supporting the cartridge 200. It should be understood, and readily apparent to those of ordinary skill in the art, that while, in this embodiment, the removable cartridge 200 is shown to include the image carrying body 211 as a separately provided from the casing 221 of the developing unit 220, other embodiments are also possible, in which the image carrying body 211 may be provided within the casing 221, or in the alternative, the removable cartridge 200 may not even include the image carrying body 211 as a part of the removable cartridge 200.

As best illustrated in FIG. 1, a first mounting hole 110 and a second mounting hole 120 are provided on the main body frame 100. The first mounting hole 110 allows the driving gear unit 320 to protrude towards the interior of the main body frame 100 when the support bracket 300 is installed on the main body frame 100. The second mounting hole 120 allows the driving gear unit 330, and the guides 340 and 350 to be accessible from the interior of the main body frame 100 when the support bracket 300 is installed in the main body frame 100. It should also be readily apparent to those of ordinary skill in the art that, while the support bracket 300 is described, in this particular embodiment, as including both driving gear units 320 and 330, and also both guides 340 and 350, when, for example, the removable cartridge 200 does not include the image carrying body 211 as a part thereof, the support bracket could be provided without the driving gear unit 320 and/or the guide 340.

The cartridge 200 may form, e.g., if the image carrying body 211 is included, a visible toner or developer image, which can be transferred to a printing medium, e.g., a sheet of printing paper or the like. More specifically, the cartridge 200 may store the developer, e.g., within the casing 221 of the developing unit 220, and may include a developing roller or rollers 223, which supplies the developer to the image carrying body 211 to visibly develop the latent image on the surface of the image carrying body 211 to produce a visible developer image. The visible developer image can be transferred onto the printing medium in cooperation with a transfer roller (not shown).

Figure 3:
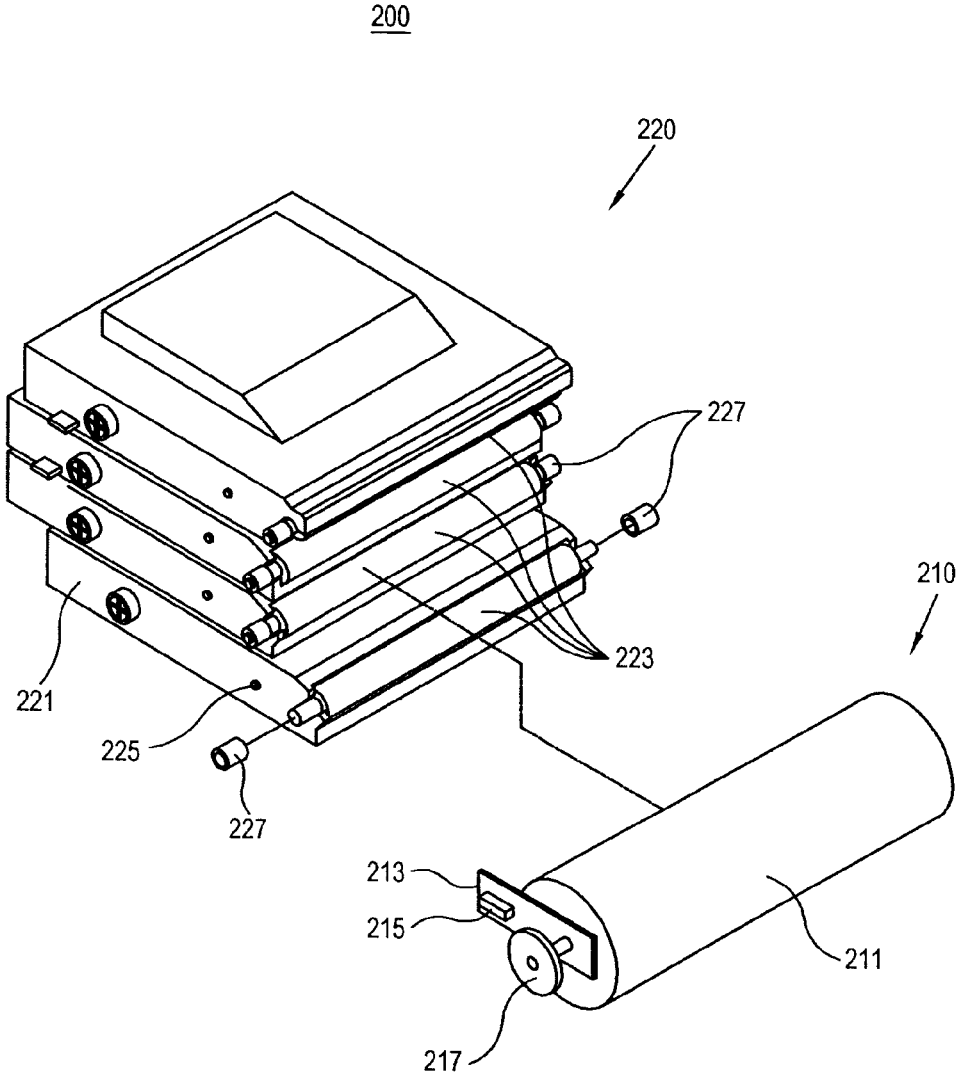
FIG. 3 is a perspective view illustrating a cartridge in the image forming apparatus according to an embodiment of the present invention.
Figure 4:
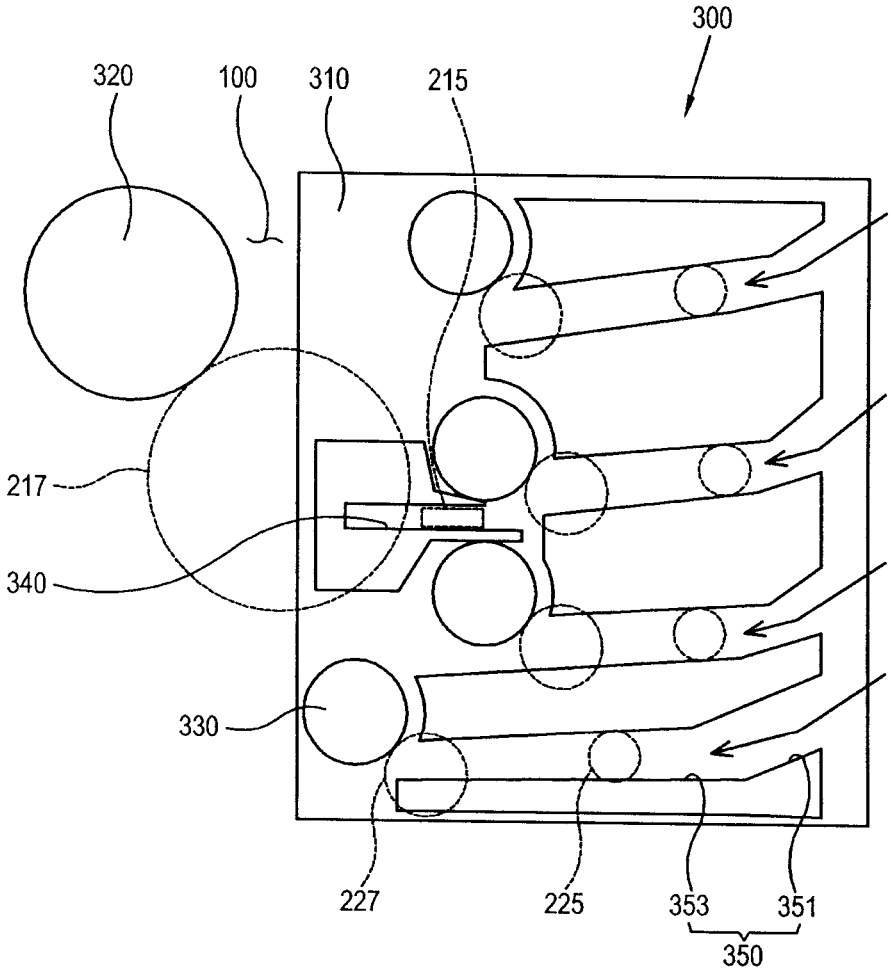
FIG. 4 is a sectional view illustrating relevant portions of the cartridge being supported by the cartridge support bracket in the image forming apparatus according to an embodiment of the present invention.

Referring to FIG. 3, the cartridge 200 may include an image carrying unit 210, for forming an electrostatic latent image and/or the visible image thereon, and a developing unit 220 supplying the developer to the image carrying unit 210.

Again in this example, the cartridge 200 is described to include two components, namely the image carrying unit 210 and the developing unit 220, the image carrying unit 210 being provided separate from the casing 221 of the cartridge 200. According to this example, and in the description thereof to follow, the support structures 215 and 225 and the driven gear units 217 and 227 are provided for the cartridge 200 while, for the support bracket 300, the driving gear units 320 and 330 and the guides 340 and 350, respectively, are provided for supporting both of the image carrying unit 210 and the developing unit 220. However, other configurations may be possible. For example, the image carrying unit 210 may be provided within the same casing 221 as the developing unit 220. It is also possible that the image carrying unit 210 may not be included as a part of the cartridge 200, in which case the support bracket 300 may only include the driving gear units 330 and the guides 350. It should also be noted that while, in this color image forming apparatus example, the cartridge 200 is shown and described as having four developing rollers 223, it should be readily apparent to one of ordinary skill that the cartridge 200 may include any number of developing rollers 223, or even only one developing roller 223 as that would be the typical cartridge in a monochrome image forming apparatus.

The image carrying unit 210 may include the image carrying body 211, a bushing 213 rotatably supporting the image carrying body 211, a first support structure 215 formed on the bushing 213, and a first driven gear 217 disposed to one end of the image carrying body 211 for causing the image carrying body 211 to rotate when the first driven gear 217 receives a rotational force from the driving gear unit 320, and when the cartridge 200 is installed in the image forming apparatus 1 as will further be described below.

The image carrying body 211 may have an elongated cylindrical drum shape, and has a photosensitive surface on which an electrostatic latent image may be formed. The electrostatic latent image may be developed into a visible image by an application of a supply of developer from the developing device 220 over the surface of the image carrying body 211, the developer being attached to select regions of the photosensitive surface of the image carrying body 211 based on the difference of electric or electrostatic charge across the electrostatic latent image.

The bushing 213 rotatably supports the image carrying body 211, and allows the image carrying body 211 to be detachably mounted to the support bracket 300. In the example shown, the surface of the bushing 213, when mounted to the support bracket 300, and thus to the, main body frame 100, may be substantially parallel with the surface of the main body frame 100.

The first support structure 215 protrudes from the surface of the bushing 213 facing the bracket device 300. The first support structure 215 is mounted and guided into the mounted position along the bracket device 300, more specifically, by a first guide 340. The image carrying unit 210 can be supported on the bracket device 300 when so mounted.

The first support structure 215 is guided by the first guide 340 to move into the proper mounted position when the image carrying unit 210 is mounted to the bracket device 300. During the mounting, the first support structure 215 moves along the first guide 340, and stops when the first driven gear 217 is engaged with a first driving gear unit 320. Accordingly, the first support structure 215 supports the image carrying unit 210 with respect to the bracket main body 310.

The first driven gear 217 is disposed on one end of the image carrying body 211 in such arrangement to prevent an interference with the bushing 213. The first driven gear 217 is connected with the image carrying body 211 so that the image carrying body 211 can be rotated by rotatably driving the first driven gear 217. When the image carrying unit 210 is mounted to the support bracket 300, the first driven gear 217 is engaged with the first driving gear unit 320. Accordingly, the image carrying body 211 can be made to rotate by the first driving gear unit 320 driving the first driven gear 217.

The developing device 220 supplies the developer to the image carrying body 211. The image forming apparatus 1 according to the embodiment may form a color image. The developing device 220 may store various color developers, and may supply the stored color developers to the image carrying body 211 to form the color image.

For example, the developing unit 220 may supply four color developers, e.g., cyan, magenta, yellow and black to the image carrying body 211. The developing unit 220 includes developing device casings 221 respectively storing the various color developers. A developing roller 223 for each of the developing device casings 221 may be provided to face the image carrying body 211, and may supply the developer of the respective developing device casing 221 to the image carrying body 211. A second support structure 225 provided on the developing device casing 221. A second driven gear 227 may be disposed on one end of each of the developing roller 223.

In the developing device 220, according to the embodiment, a separate developing device casings 221 is provided for each developer color. However, various other configurations may be employed. For example, the developing device 220 may be provided with a plurality of developer accommodating spaces partitioned within a single casing. As previously stated, in yet another embodiment, e.g., of a monochrome image forming apparatus, the developing device 220 may store and supply only one color developer, and may include a single casing 221 and a single developing roller 223.

The developing roller 223 and image carrying body 211 may be arranged to so that each may rotate about a respective rotational axis along the longitudinal direction, the two rotational axes being substantially parallel to each other. The mounting direction of the cartridge 200 may be substantially transverse to the rotational axes of the developing roller 223 and the image carrying body 211.

The second support structure 225 protrudes from the outer surface of the developing device casing 221. The second support structure 225 is guided into the mounted position, and supported, by the support bracket 300, more particularly, by a second guide 350 such that the developing unit 220 can be supported by the support bracket 300, and on the main body frame 100.

The second support structure 225 moves along, while being guided into position by, the second guide 350 when the developing unit 220 is being mounted to the support bracket 300, and stops when the second driven gear 227 is engaged with a second driving gear unit 330. Accordingly, the second support structure 225 supports the developing device 220 with respect to the bracket main body 310.

The second driven gear 227 is engaged with the second driving gear unit 330 when the developing device 220 is mounted to the bracket device 300. The second driven gear 227 is connected to the developing roller 223 in an interlocking manner. Accordingly, the second driven gear 227 transfers the driving force transmitted from the second driving unit 330 to the developing roller 223 to cause the developing roller 223 to rotate.

The support bracket 300 supports the cartridge 200 while being fixed to the main body frame 100 so that the cartridge 200 can be supported to the main body frame 100. The support bracket 300 is coupled to the main body frame 100 by placing the support bracket 300 from the exterior of the main body frame 100 to position the first and second driving gear units 320 and 330 to be placed within the interior of the main body frame 100. The support bracket 300 may be coupled to the main body frame 100 by a screw, a rivet, or other various known coupling means.

The support bracket 300 includes the bracket main body 310 to be coupled the main body frame 100, the first driving gear unit 320 and the second driving gear unit 330, disposed to the bracket main body 310, for receiving a driving force from a driving source (not shown). Also, the support bracket 300 is provided with the first guide 340 and the second guide 350 formed on the surface of the bracket main body 310 at a predetermined position relative to the first driving gear unit 320 and the second driving gear unit 330, respectively.

When the support bracket 300 is being installed on the main body frame 100, the first driving gear unit 320 passes through the first mounting hole 110 from the rear surface of the main body frame 100, and the second driving gear unit 330, the first guide 340 and the second guide 350 pass through the second mounting hole 120. These components passing through the first mounting hole 110 and the second mounting hole 120 are disposed on the mounting path of the cartridge 200 such that the components respectively correspond to the support structures, 215 and 225, and the driven gears 217 and 227.

When the cartridge 200 is mounted and supported to the support bracket 300, the support structures, 215 and 225, and the driven gears 217 and 227 of the cartridge 200 are respectively placed on the guides, 340 and 350, and engaged with the driving gear units 320 and 330 of the support bracket 300. That is, for this embodiment, in which the image carrying unit 210 is included in the cartridge 200, both of the guides 340 for supporting the support structure 215 of the image carrying unit 210 and the driving gear unit 320 for driving the image carrying body 211 are provided on the support bracket 300. Also, both of the guides 350 for supporting the support structure 225 and the driving gear unit 330 for driving the driven gears 227 are provided on the bracket main body 310. Accordingly, when the cartridge 200 is supported to the main body frame 100, the amount of variance in the relative respective positions between the driving gear units 320 and 330 on one hand and the driven gears 217 and 227 on the other hand can be minimized, due, e.g., to an imprecise mounting of the support bracket 300, to a shift in the relative position of the support bracket 300 with respect to the main body frame 100 over time, or to any other causes.

The bracket main body 310 may be formed of various materials such as steel, aluminum, or the like, in consideration of factors, which may include, e.g., the strength, the weight, or the like of the material. The manufacturing of the bracket main body 310 may employ, e.g., an injection molding, a pressing molding, or other various known methods. The bracket main body 310 is preferably, but not necessarily, manufactured integrally with the guides 340 and 350. Alternatively, the guides 340 and 350 may be of structures to allow separate coupling to the bracket main body 310.

When the bracket main body 310 is mounted to the main body frame 100, the first driving gear unit 320 passes through the first mounting hole 110 to be positioned for later engagement with the first driven gear 217. The first driven gear 217 is appropriately distanced from the surface of the main body frame 100 to prevent an interference with the second driving gear unit 330, the first guide 340 and the second guide 350 during the mounting of the image carrying unit 210. In an embodiment, the first driving gear unit 320 may be disposed to extend further beyond the second driving gear unit 330, the first guide 340 and the second guide 350 to be engaged to the first driven gear 217.

The first driving gear unit 320 receives the driving force from a driving source that supplies a motional force, e.g., a rotational force. The driving source may take various forms, and may employ various installation positions and configurations. For example, the driving source may include a motor disposed to the main body frame 100. The driving force from the driving source may be transmitted to the first driving gear unit 320 and the second driving gear unit 330 by means of a gear, a cam, a connecting rod or any other mechanisms known in the art. The first driving gear unit 320 transmits this driving force to rotationally drive the first driven gear 217, and, in turn, the image carrying body 211.

The first driving gear unit 320 includes a first gear cover 321 covering an area not engaged with the first driven gear 217 to protect the gear of the first driving gear unit 320. The first gear cover 321 passes through the first mounting hole 110 when the bracket main body 310 is mounted to the main body frame 100.

The second driving gear unit 330 passes through the second mounting hole 120 to be accessible from the interior of the main body frame 100 for engagement with the second driven gear 227. The second driving gear unit 330 receives the driving force from the driving source to rotate the second driven gear 227, and, in turn, the developing roller 223.

Each of the gears of the second driving gear unit 330 is disposed to respectively correspond to the developing rollers 223 for each colored developer.

The second driving gear unit 330 includes a second gear cover 331 covering an area not engaging with the second driven gear 227 to protect the gears of the second driving gear unit 330. The second gear cover 331 is of the size and shape to pass through the second mounting hole 120 when the bracket main body 310 is mounted to the main body frame 100.

The first guide 340 extends on the bracket main body 310 along the mounting direction of the cartridge 200, more specifically, along the mounting direction of the image carrying unit 210. The first guide 340 guides, by being in a sliding contact with the first support structure 215, and supports the first support structure 215 so that the image carrying unit 210 can be supported in the support bracket 300.

As the first support structure 215 is guided along the guide 340 into position, when the first driven gear 217 becomes engaged with the first driving gear unit 320, the image carrying unit 210 is stopped from moving further, and is supported by the support bracket 300 in this mounted position.

The first guide 340 is disposed in a position so as to prevent an interference with the second driving gear unit 330 and the second guide 350 so that the image carrying unit 210 can be mounted. To this end, for example, the first guide 340 may be provided at a stepped up position or a position extending further out from the surface of the bracket main body 310 to have a clearance beyond the positions of the second driving gear unit 330 and the second guide 350.

The first guide 340 may include a stopper (not shown) interfering the first support structure 215 so as to prevent the image carrying unit 210 from moving beyond a predetermined position. The stopper may also provide a snap-fit shape to which the first support structure 215 may fit into so that the first support structure 215 can be securely supported. These aspects of the stopper may be applied to the second guide 350 as well.

The second guide 350 allows a sliding movement of the second support structure 225 along its surface, and supports the second support structure 225 so that the developing device 220 can be supported to the support bracket 300. When the second driven gear 227 is engaged with the second driving gear unit 330 while the second support structure 225 being guided into position, the developing device 220 stops from moving further, and is supported in the support bracket 300 in this mounted position.

The second guide 350 includes an entrance portion 351, into which the second support structure 225 enters, and a guiding portion 353 extending from the entrance portion 351, and to be in sliding contact with, and to thus guide, the second support structure 225 along its surface. While not necessary, it may be preferable that the width of the entrance portion 351 is larger than the width of the guiding portion 353. At least one of the entrance portion 351 and the guiding portion 353 may be provided with a downward incline to help the developing device 220 to slide into position by its own weight. This configuration is not confined to the second guide 350, but may also be applied to the first guide 340.

Hereinafter, a mounting process of the cartridge 200 in the image forming apparatus 1 according to an embodiment will be described by referring to FIGS. 1 to 4. Here, an initial state refers to a state in which the support bracket 300 is not coupled to the main body frame 100.

From the initial state, the support bracket 300 is first coupled to the main body frame 100. The first driving gear unit 320 is placed through the first mounting hole 110, and the second driving gear unit 330, the first guide 340 and the second guide 350 placed through the second mounting hole 120 to be disposed on the mounting path of the cartridge 200. Also, the first driving gear unit 320 and the second driving gear unit 330 are connected to the driving source so that the driving force can be transmitted.

Next, the image carrying unit 210 is mounted to the support bracket 300. The first support structure 215 enters the first guide 340, and moves until the first driven gear 217 is engaged with the first driving gear unit 320. Accordingly, the image carrying unit 210 is placed in its operational position and, is supported by the support bracket 300 in such position.

The developing device 220 is mounted to the support bracket 300. The second support structure(s) 225 enters the second guide 350. In this embodiment, since the width of the entrance unit 351 is larger than the width of the guiding unit 353 and the width of the second support structure 225, the second support structure 225 can smoothly enter the second guide 350. The second support structure 225 moves along the guiding unit 353 until the second driven gear unit 227 is engaged with the second driving gear unit 330.

Accordingly, the developing roller 223 is positioned in place to supply the developer to the image carrying body 211, and the developing device 220 is supported to the support bracket 300 in such operational position.

During the operation of the image forming apparatus 1, the first driving gear unit 320 and the second driving gear unit 330 are driven to in turn respectively drive the first driven gear unit 217 and the second driven gear unit 227. Accordingly, the image carrying body 211 and the developing roller 223 rotate. Accordingly, the visible image can be formed with the developer on the image carrying body 211, which can be transferred onto printing medium in cooperation with a transfer unit (not shown).

In this exemplary configuration, the driving gear units 320 and 330 and the guides 340 and 350 are all disposed on the support bracket 300 at a fixed relative positional relationship with respect to each other, and, when the support bracket 300 is mounted to the main body frame 100, the effect of the possible positional shifts or variance in the coupling between the support bracket 300 and the main body frame 100 could have on the engagement between the driving gear units 320 and 330 and also between the driven gear units 217 and 227, thereby minimizing the out of tolerance engagement.

In the present exemplary embodiment, the cartridge 200 comprises the image carrying unit 210 and the developing device 220 as two separate units. It should be readily apparent, however, that the cartridge 200 may have a configuration, in which the image carrying unit 210 and the developing device 220 may be provided in a single casing.

Also, the guides 340 and 350 are provided integrally with the bracket main body 310. Alternatively, the guides 340 and 350 may be assembled to the bracket main body 310.

Also, the support structures 215 and 225 are provided as a protrusion, and the guides 340 and 350 are provided as a groove or a recess to accommodate the protrusion. However, other configurations may be applied thereto. For example, the support structures 215 and 225 may be provided as a groove formed on the bushing 213 or the developing device casing 221, and the guides 340 and 350 may be provided as a protrusion protruding from the bracket main body 310.

As described above, the various embodiments of an image forming apparatus herein described may promote and/or maintain proper an engagement position between a driving gear unit and a driven gear unit in mounting of a cartridge in the image forming apparatus, and thereby prevent missteps of the gear units, which may result in a poor image quality, and also may improve a lifespan of the cartridge or the image forming apparatus and overall reliability of the apparatus.

Although a few exemplary embodiments of the present invention have been shown and described, it will be appreciated by those skilled in the art that changes may be made in these exemplary embodiments without departing from the principles and spirit of the invention, the scope of which is defined in the appended claims and their equivalents.

What is claimed is:

1. An image forming apparatus, comprising:

a main body frame to accommodate at least one removable process cartridge; and a bracket configured to be coupled to said main body frame by placing said bracket from the exterior of said main body frame and having at least one driving gear unit and at least one support guide, said at least one driving gear unit being configured to engage at least one driven gear unit of said removable process cartridge when said removable process cartridge is mounted in a mounted position within said image forming apparatus, said at least one support guide being configured to guide said removable process cartridge into said mounted position during mounting of said removable process cartridge in said image forming apparatus.

2. The image forming apparatus according to claim 1, said removable process cartridge comprising:

at least one movable portion configured to move according to a motional force received from said at least one driven gear unit; and at least one mounting support portion configured to be in a sliding contact with said at least one support guide during said mounting of said removable process cartridge, said at least one mounting support portion being supported by said at least one support guide when said removable process cartridge is in said mounted position.

3. The image forming apparatus according to claim 2, wherein:

said at least one mounting support portion comprises one or more protrusions extending outward from an outer surface of said removable process cartridge; and said at least one support guide comprises one or more grooves extending along said bracket main body, each of said one or more grooves being configured to receive at least a part of a corresponding one of said one or more protrusions.

4. The image forming apparatus according to claim 3, wherein:

at least one of said one or more grooves comprises an entrance portion into which said corresponding one of said one or more protrusions enters during said mounting of said removable process cartridge, said entrance portion having a larger opening than remaining portions of said one or more grooves.

5. The image forming apparatus according to claim 1, wherein said at least one support guide is integrally formed on said bracket main body.

6. The image forming apparatus according to claim 2, wherein said at least one movable portion comprises:

an image carrying body disposed within said removable processing cartridge, said image carrying body being configured to form an electrostatic latent image on a surface thereof.

7. The image forming apparatus according to claim 6, wherein:

said at least one driving gear unit comprises a first driving gear unit, wherein said first driving gear unit is configured to engage, when said removable process cartridge is mounted in said image forming apparatus, with a first driven gear unit, said first driven gear unit being coupled to, and being configured to convey a first rotational force received from said first driving gear unit to, said image carrying body.

8. The image forming apparatus according to claim 7, wherein said at least one movable portion further comprises one or more developing rollers disposed within said removable process cartridge, said one or more developing rollers each being configured to supply an amount of developer to said image carrying body to develop said electrostatic latent image into a visible image, and wherein said at least one driving gear unit further comprises a second driving gear unit, said second driving gear unit being configured to engage a second driven gear unit, said second driven gear unit being coupled to, and being configured to convey a second rotational force received from said second driving gear unit to, said one or more developing rollers.

9. The image forming apparatus according to claim 8, wherein:

said main body frame comprises a first through hole and second through hole, said first through hole providing a first opening through which said first driving gear unit of said bracket is allowed enter into an interior portion of said main body frame during mounting of said bracket onto said main body frame, said second through hole providing a second opening through which said second driving gear unit is allowed enter into said interior portion of said main body frame during mounting of said bracket onto said main body frame.

10. The image forming apparatus according to claim 8, wherein:

said second driving gear unit comprises a first plurality of gears, each configured to engage with a respective corresponding one of a second plurality of gears of said second driven gear unit, each of said second plurality of gears being configured to rotate a respective corresponding one of said one or more developing rollers each being configured to supply a respective different color developer to said image carrying body.

11. A bracket to support a removable process cartridge within a main body frame of an image forming apparatus, comprising:

a bracket main body coupled to said main body frame by placing said bracket from the exterior of said main body frame;

at least one driving gear unit disposed on said bracket main body, said at least one driving gear unit being configured to engage at least one driven gear unit of said removable process cartridge when said removable process cartridge is mounted in a mounted position within said image forming apparatus; and at least one support guide disposed on said bracket main body, said at least one support guide being configured to guide said removable process cartridge into said mounted position during mounting of said removable process cartridge in said image forming apparatus.

12. The bracket according to claim 11, wherein:

said at least one support guide comprises one or more grooves extending along said bracket main body, each of said one or more grooves being configured to receive at least a part of a corresponding one of one or more protrusions formed on an outer surface of said removable process cartridge.

13. The bracket according to claim 12, wherein:

at least one of said one or more grooves comprises an entrance portion into which said corresponding one of said one or more protrusions enters during said mounting of said removable process cartridge, said entrance portion having a larger opening than remaining portions of said one or more grooves.

14. The bracket according to claim 11, wherein said at least one support guide is integrally formed on said bracket main body.

15. The bracket according to claim 11, wherein:

said at least one driving gear unit comprises a first driving gear unit and a second driving gear unit;

said first driving gear unit is configured to engage, when said removable process cartridge is mounted in said image forming apparatus, with a first driven gear unit, said first driven gear unit being coupled to, and being configured to convey a first rotational force received from said first driving gear unit to, an image carrying body disposed within said removable processing cartridge, said image carrying body being configured to form an electrostatic latent image on a surface thereof; and said second driving gear unit is configured to engage a second driven gear unit, said second driven gear unit being coupled to, and being configured to convey a second.

* * * * *